United States Patent [19]

Foss

[11] Patent Number: 4,468,944

[45] Date of Patent: Sep. 4, 1984

[54] GAP INDICATING MEANS FOR A ROLLING MILL

[75] Inventor: Alan Foss, Wath-on-Dearne, Near Rotherham, England

[73] Assignee: Davy-Loewy Limited, Sheffield, England

[21] Appl. No.: 284,132

[22] Filed: Jul. 16, 1981

[51] Int. Cl.[3] ..... B21B 31/34

[52] U.S. Cl. ..... 72/35; 72/248; 324/207

[58] Field of Search ..... 73/DIG. 2; 72/21, 35, 72/36, 248; 324/207, 209

[56] References Cited

U.S. PATENT DOCUMENTS 3,353,385 11/1967 Neumann et al. ..... 72/21

FOREIGN PATENT DOCUMENTS 1322397 7/1973 United Kingdom .
1355662 6/1974 United Kingdom .

OTHER PUBLICATIONS

"Measurement of Mine Roof Movement"-Prepared for U.S. Dept. of the Interior, Bureau of Mines by Ivor Hawkes Associates, Jul. 1978.

*Primary Examiner*—Daniel C. Crane
*Attorney, Agent, or Firm*—Schwartz & Weinrieb

[57] ABSTRACT

A rolling mill has a transducer for measuring the separation of a movable part of the mill from the fixed part of the mill. The transducer comprises a magnetostrictive element secured to one end of the fixed part, a transmitter for transmitting magnetostrictive signals into the element, a receiver for receiving signals reflected back along the element and a magnet secured to the other part which produces a magnetic field which serves to reflect the signals along the element. A timer measures the time interval between transmitting the energy and receiving the echo and this is representative of the distance between the two parts of the rolling mill.

14 Claims, 4 Drawing Figures

GAP INDICATING MEANS FOR A ROLLING MILL

Field of the Invention

This invention relates to rolling mills having an electrical transducer arranged to indicate the position of a movable part of the rolling mill with respect to a fixed part thereof.

Background of the Invention

Rolling mills consist essentially of at least one pair of rotatable rolls mounted at their ends in bearing chock assemblies which are supported in a fixed mill housing. Means are provided for moving at least one of the rolls and its bearing chock assemblies with respect to the mill housing in the direction to thereby adjust the gap between the rolls. This movement of the roll and its bearing chock assemblies may be brought about by means of screws threaded in nuts positioned in the fixed housing and bearing on the chock assemblies of the roll or alternatively each bearing chock assembly may have a hydraulic ram disposed between it and the fixed part of the mill housing. By expanding or contracting the rams, the roll and its bearing chock assemblies are moved relative to the mill housing in the direction to adjust the gap between the rolls.

To determine the position of the roll and its bearing chock assemblies relative to the fixed housing, it is usual to include some form of measuring device which measures the movement of the roll. When the roll and its bearing chock assemblies are moved by screws, the rotation of each screw may be transmitted by a Selsyn train to a measuring device. This arrangement suffers from the disadvantage of the need for couplings, and back-lash in the couplings, and a Selsyn train brings about a reduction in the overall accuracy of the arrangement.

When hydraulic rams are employed, it is usual to connect an electric linear transducer between the movable and fixed parts of each ram to determine relative positions of the parts. Difficulties can occur in obtaining transducers of sufficiently long stroke which are sufficiently accurate along the entire length of their stroke.

Summary of the Invention

According to the present invention a rolling mill has a fixed part, a part movable linearly with respect to the fixed part and an electrical transducer for indicating the position of the movable part with respect to the first part, said transducer comprising an elongate magnetostrictive element secured to one of the parts, an electronic transmitter for transmitting magnetostrictive signals into said element, an electronic receiver for receiving magnetostrictive signals reflected back along said element, magnetic means secured to said other part and associated with said element to produce a magnetic field which serves to reflect said signals transmitted along said element back to said receiver and timing means for measuring the time interval between the transmission and the reception of said signals, said time interval being representative of the separation of said parts.

A prime advantage of the invention is that there is no contact between the fixed and movable parts when the measurement is made.

Brief Description of the Drawings

In order that the invention may be more readily understood it will now be described, by way of example only, with reference to the accompanying drawings, in which.

DETAILED DESCRIPTION OF THE ILLUSTRATED EMBODIMENTS

Figure 1:
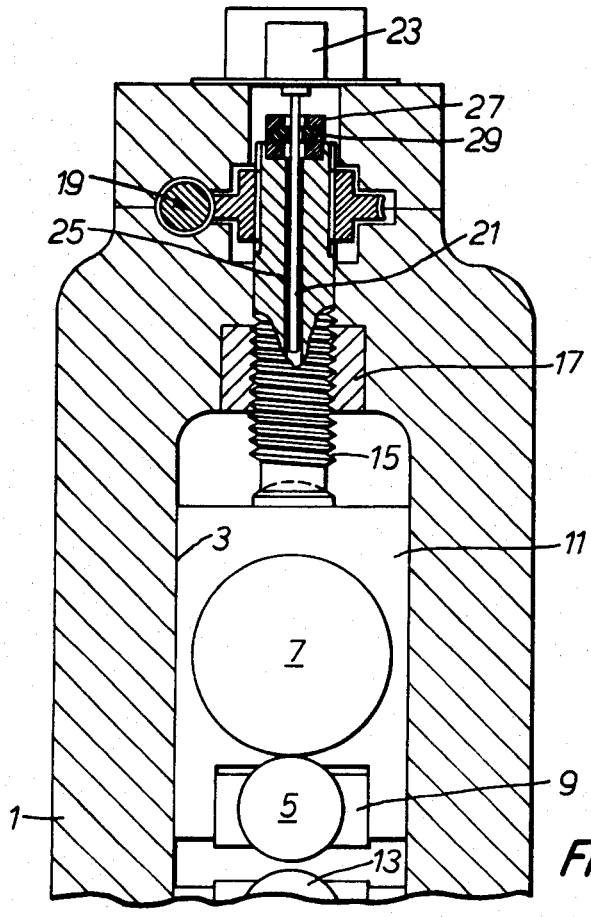
FIG. 1 is a diagrammatic side elevation of part of a rolling mill in accordance with one embodiment of the invention.

Referring to FIG. 1, a rolling mill has a fixed housing 1 defining a window 3. Contained within the window there are bearing chock assemblies for upper and lower roll assemblies. The upper roll assembly consists of a work roll 5 and a back-up roll 7 and the ends of these rolls are supported in bearing chock assemblies 9 and 11 respectively. The lower roll assembly similarly consists of a work roll and a backup roll supported at their ends in bearing chock assemblies but only the work roll 13 is shown in the figure.

The upper work roll assembly is connected to the lower ends of a pair of screws, one of which 15 is shown in the figure. Each screw is threaded in a nut 17 fixed in the housing 1 and the screws are rotated in the nuts by worm and wheel apparatus 19 to raise and lower the screws and hence the roll assembly relative to the fixed mill housing.

To determine the angular position of the screws and hence the position of the roll assembly relative to the housing, each screw has a transducer associated with it. Each transducer comprises an elongate magnetostrictive element 21 projecting from a casing 23 which is mounted on the top of the housing. The element projects into a central bore 25 in the screw 15. The length of the element is such that its end is always spaced from the closed end of the bore 25.

In the upper end of thhe screw there is an enlarged central opening containing a plastics casing 27 which supports an annular permanent magnet 29 in surrounding relation with the element 21.

The casing 23 encloses a transmitter and a receiver of magnetostrictive signals.

In use, the transmitter is energised causing it to transmit waves of magnetostrictive energy into the element 21. The waves pass along the element until they encounter the magnetic field set up by the magnet 29 and they are reflected by the magnetic field back along the element to the receiver. A timer is employed to measure the time interval between the transmission and the reception of the waves and this value is representative of the distance between the transmitter/receiver and the magnet. When the screw is rotated, magnet 29 is displaced lengthwise of the element, thereby changing the position of the magnet with respect to the casing 23. The time interval for the passing and return of the waves along the element is representative of the distance between the magnet 29 and the upper end of the fixed housing and this is representative of the distance between the upper roll assembly and the upper end of the housing.

Figure 2:
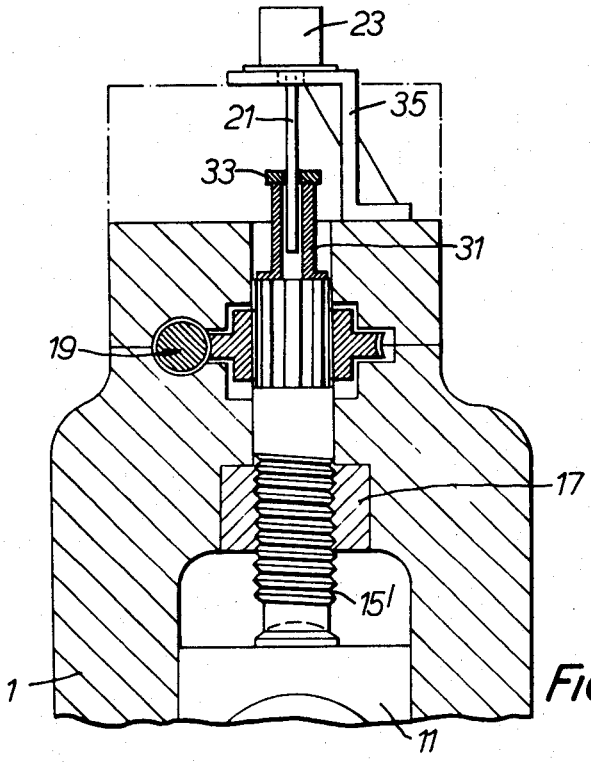
FIG. 2 is a diagrammatic side elevation of part of a rolling mill in accordance with another embodiment of the invention.

In the arrangement shown in FIG. 2, there is no necessity for the screw 15' to have a central bore. A tube 31 is mounted on the upper end of the screw with the bore of the tube in line with the axis of the screw. The tube projects through an opening in the upper end of the housing and an annular magnet 33 is mounted on the upper end of the tube. The elongate element 21 extends through the magnet 33 into the tube 31. The casing 23 at the upper end of the element is mounted on a bracket 35 on the upper end of the housing.

Figure 3:
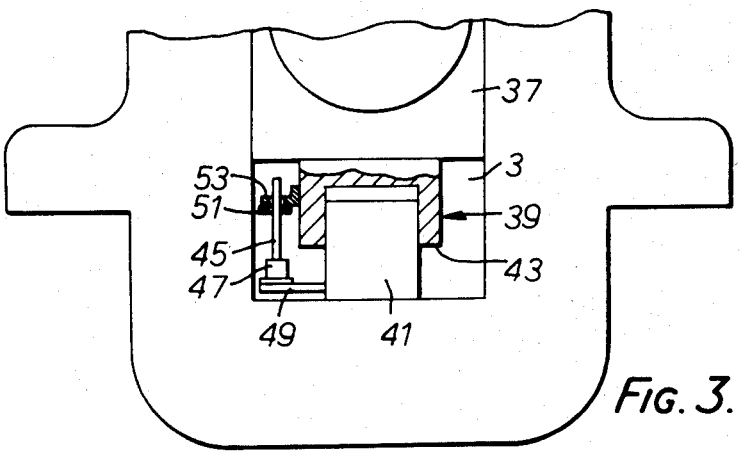
FIG. 3 is a diagrammatic side elevation of part of a rolling mill in accordance with a further embodiment of the invention.

In the alternative arrangement shown in FIG. 3, the invention is applied to a hydraulic rolling mill. The lower end of the mill housing is shown in this figure and, at the bottom of the window 3 beneath the bearing chock assembly 37 of the lower roll assembly, there is a piston-cylinder device 39. This device comprises a fixed piston 41 in a cylinder 43 beneath the work roll assembly. By introducing fluid under pressure into the cylinder, the lower roll assembly is raised and lowered relative to the fixed housing. The transducer associated with the piston-cylinder device 39 comprises a magnetostrictive element 45 projecting upwards from a casing 47 mounted on a bracket 49 attached to the piston 41. The element projects through an annular permanent magnet 51 secured to a bracket 53 extending from the cylinder 43. As the cylinder 43 moves verticaly with respect to the piston 41, the magnet 51 is displaced along the length of the element 45.

Figure 4:
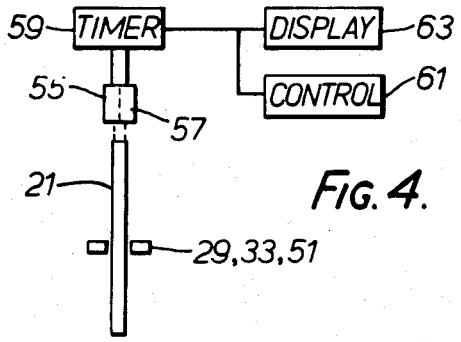
FIG. 4 is a circuit block diagram showing the operation of the transducer.

A circuit diagram of the transducer which is applicable to all the embodiments of the invention is shown in FIG. 4. The magnetostrictive element 21 is shown surrounded by the permanent magnet (29, 33, 51). A transmitter 55 of magnetostrictive energy and a receiver 57 of the reflected energy are shown positioned at the upper end of the element. A timer 59 is set by a control 61 when the energy is transmitted and is stopped when the reflected energy is received, thus giving a measure of the time taken for the energy to be transmitted along the element to the magnet and then returned to the receiver. A display device 63 displays this measure and, by calibrating the device, the display device can be used to display a direct reading of the distance between the fixed and movable parts of the rolling mill.

The magnetostrictive waves transmitted along the element conveniently have a frequency of the order of 8 Kc/s.

The magnetostrictive element and the associated electronic equipment may be purchased from TEMPO SONICS of Long Island, N.Y., U.S.A.

Obviously, many modifications and variations of the present invention are possible in light of the above teachings. It is therefore to be understood that within the scope of the appended claims, the present invention may be practiced otherwise than as specifically described herein:

I claim:

1. A rolling mill, comprising:

a fixed mill housing;

an upper roll assembly disposed within said fixed mill housing;

a lower roll assembly disposed within said fixed mill housing;

a nut disposed internally of said fixed mill housing;

screw means disposed internally of said fixed mill housing and threadedly engaged with said nut for rotational and axial movement relative to said nut, said screw means also being operatively engaged with one of said upper and lower roll assemblies so as to move said one of said upper and lower roll assemblies relative to said fixed mill housing and said other one of said upper and lower roll assemblies so as to adjust the gap defined between said upper and lower roll assemblies;

drive means disposed internally of said fixed mill housing and operatively engaged with said screw means for rotating said screw means relative to said nut whereby said screw means will axially translate relative to said nut and said fixed mill housing;

an axially extending bore defined within said screw means;

a first transducer component mounted upon said screw means; and a second transducer component mounted upon said fixed mill housing so as to project into said axially extending bore of said screw means and operatively cooperate with said first transducer component mounted upon said screw means for indicating the disposition of said screw means and said one of said upper and lower roll assemblies relative to said fixed mill housing and said other one of said upper and lower roll assemblies, and thereby said gap defined between said upper and lower roll assemblies.

2. A rolling mill as set forth in claim 1, wherein:

said first and second transducer components comprise an electrical transducer.

3. A rolling mill as set forth in claim 2, wherein said electrical transducer comprises:

an elongate magnetostrictive element secured to said fixed mill housing;

an electronic transmitter for transmitting magnetostrictive signals into said element;

an electronic receiver for receiving magnetostrictive signals reflected back along said element;

magnetic means secured to said screw means and operatively associated with said element so as to produce a magnetic field which serves to reflect said signals transmitted along said element back to said receiver; and timing means for measuring the time interval between the transmission and reception of said signals, said time interval being representative of said gap defined between said upper and lower roll assemblies.

4. A rolling mill as claimed in claim 3, in which the transmitter and the receiver are contained within a casing at one end of the element.

5. A rolling mill as claimed in claim 3, in which the element is stationary and extends into said axially extending bore in said screw means.

6. A rolling mill as claimed in claim 3, in which the element is stationary and projects into a tube mounted on the upper end of said screw means and the magnetic means is secured to the tube.

7. A rolling mill as claimed in claim 3, in which the magnetic means is an annular permanent magnet surrounding said element.

8. A rolling mill as set forth in claim 4, wherein:

said casing is secured to said fixed mill housing.

9. A rolling mill as set forth in claim 1, wherein:

said rotating drive means comprises a worm drive.

10. A rolling mill as set forth in claim 1, wherein:

said second transducer component is mounted upon said fixed mill housing at a location remote from said drive means.

11. A rolling mill as set forth in claim 1, wherein:

said screw means is connected to said upper roll assembly; and said second transducer component projects downwardly from said fixed mill housing into said screw means.

12. A rolling mill as set forth in claim 1, wherein:

said second transducer component is mounted atop said fixed mill housing.

13. A rolling mill as set forth in claim 1, wherein:

said second transducer component is mounted exteriorly of said fixed mill housing.

14. A rolling mill as set forth in claim 1, wherein: said drive means annularly surrounds said screw means.

* * * * *